US005833505A

United States Patent [19]

Huang

[11] Patent Number: 5,833,505

[45] Date of Patent: Nov. 10, 1998

[54] MULTIPURPOSE FLOAT

[76] Inventor: Ching-Tzu Huang, Room 6, 6th Fl., No. 12, Fu-Chou 5th St., Chai-I City, Taiwan

[21] Appl. No.: 882,162

[22] Filed: Jun. 25, 1997

[51] Int. Cl.[6] ..... B63C 9/08

[52] U.S. Cl. ..... 441/129; 441/88; 441/117; 441/122

[58] Field of Search ..... 441/129, 88, 117, 441/122, 125, 65; 434/254; 472/129

[56] References Cited

U.S. PATENT DOCUMENTS 1,094,538 4/1914 Davis ..... 441/117
4,362,518 12/1982 Boisslere ..... 441/88
5,385,521 1/1995 Weissbuch ..... 434/254

FOREIGN PATENT DOCUMENTS 4 032 063 A 4/1992 Germany ..... 441/88

*Primary Examiner*—Sherman Basinger
*Attorney, Agent, or Firm*—Rosenberg, Klein & Bilker

[57] ABSTRACT

A multipurpose float is provided which employs a rotatable bar attached to a main body of the float. Four bolts, each having a snap ring disposed at the bolt head, are located in four deep holes respectively formed in four sides of the main body. The rotatable bar can be set perpendicular to the main body to prevent the float from jumping out from between the thighs of a user. Further, a plurality of the floats can be combined to form a large sized floating bed.

5 Claims, 7 Drawing Sheets

MULTIPURPOSE FLOAT

BACKGROUND OF THE INVENTION

1. Field of the Invention

The present invention relates to a multipurpose float, and more particularly to a swimming float that can be used in training, learning, playing and lifesaving.

2. Prior Art

Conventional swimming floats are typically shaped as rectangular plates made of expanded PU material, which are used for assisting a beginner in floating on the water in order to exercise correct swimming postures. So, their use is limited only to learning, without any other purpose. As in learning the butterfly stroke, the swimming float is gripped by a swimmer's two thighs in order to train the swimmer to maintain their thighs close together. But, the buoyancy of the float is so great that the float jumps out from the interspace between the user's thighs.

SUMMARY OF THE INVENTION

It is therefore a main object of the present invention to provide a multipurpose float which can be used not only in learning and training of a swimmer, but also for playing and lifesaving.

This object is achieved by a multipurpose float, which includes a main body, a rotatable bar and four bolt assemblies. Each edge of four sides of the main body of the float are formed with a deep hole centrally disposed therein. A slotted hole is formed through an inside region of each corner. The rotatable bar, having a length equal to the width of the main body, is connected at one side of the main body. The four bolts are set in each deep hole of the main body, respectively, and the flour slotted holes can be used for locating locking belts therein.

DETAILED DESCRIPTION OF THE PREFERRED EMBODIMENTS

Figure 1:
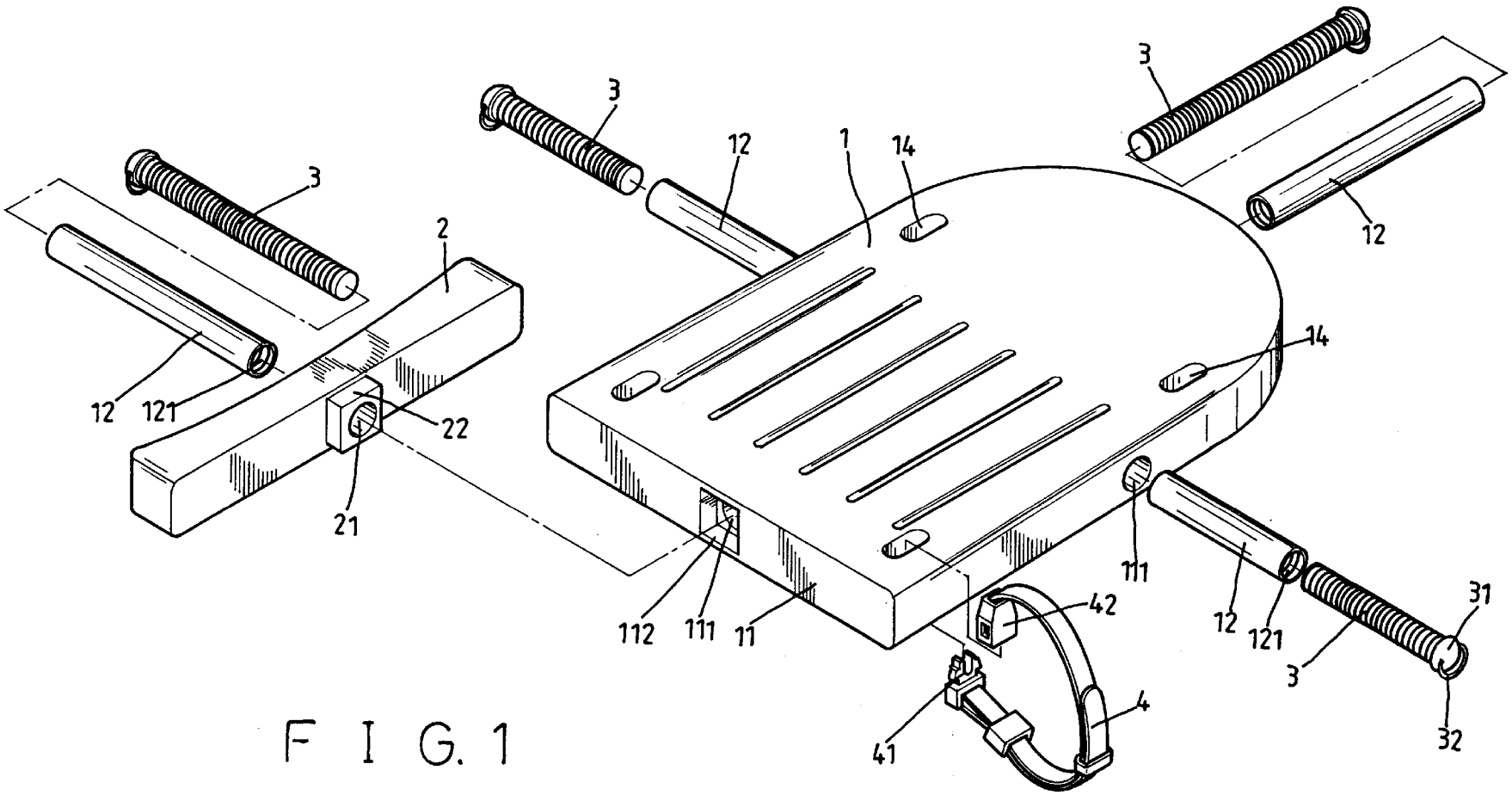
FIG. 1 is an exploded view of the present invention.

Referring to FIG. 1, the present invention includes a main body 1, a rotatable bar 2, four bolts 3 and two locking belts 4.

The main body 1 is made of an expanded PU material having a contour of a thin rectangle, in which each side edge 11, of the four edges, is drilled with a deep hole 111 centrally disposed therein. A proper length of a hollow plastic sleeve 12 having a female thread 121 formed on inner wall thereof is located in each hole 111. A quadrilaterally shaped recess 112 is formed at the open end of one deep hole 111 of one edge 11 for locating the rotatable bar 2 therein. Inside of each corner has a slotted hole 14 formed therethrough.

The rotatable bar 2, made of an identical material as that of the main body 1, has a thickness the same as the main body 1, and a length equivalent to the width of the main body 1. Corresponding to the deep hole 111 and the quadrilateral recess 112 of the main body 1, there is a quadrilateral plug 22 extending from the rear side of the rotatable bar 2, facing the main body 1, for fitting into the quadrilateral recess 112. The rotatable bar 2 has a through hole 21 formed therethrough, permitting the sleeve 12 to pass therethrough.

The bolts 3 are each made of plastic and can be screwed into a respective sleeve 12, and a snap ring 32 is located on the bolt head 31 of each bolt 3.

Each locking belt 4 has a plug joint 41 and a socket joint 42, and can pass through a respective slotted hole 14 of the main body 1.

Figure 2:
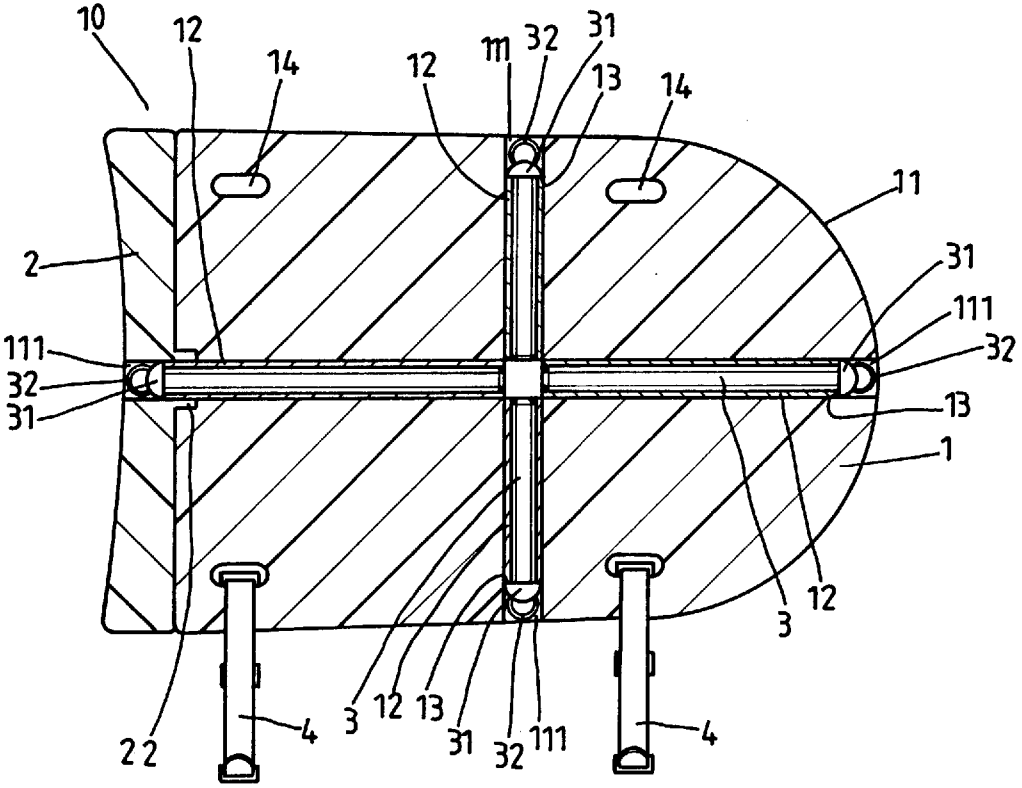
FIG. 2 is a top cross-section view of the present invention.

When assembled, as shown in FIG. 2, the sleeves 12 are disposed in respective deep holes 111 of the main body 1. The rotatable bar 2 is mounted to the main body 1 by means of inserting the quadrilateral plug 22 at the rear side of the rotatable bar 2 into the quadrilateral recess 112 of the main body 1, so that part of the sleeve 12 remains in the through hole 21 of the rotatable bar 2. The bolts 3 are threadedly engaged with the sleeves 12, respectively, to combine and integrate the swimming float 10. Because the sleeves 12 are shorter than the depth of the deep hole 111, a blind hole 13 is formed at the open end of the deep hole 111, so that the bolt head 31 and the snap ring 32 are recessed into the blind hole 13. Thus, the swimming float will have all sides flat without any parts extending out therefrom.

Figure 3:
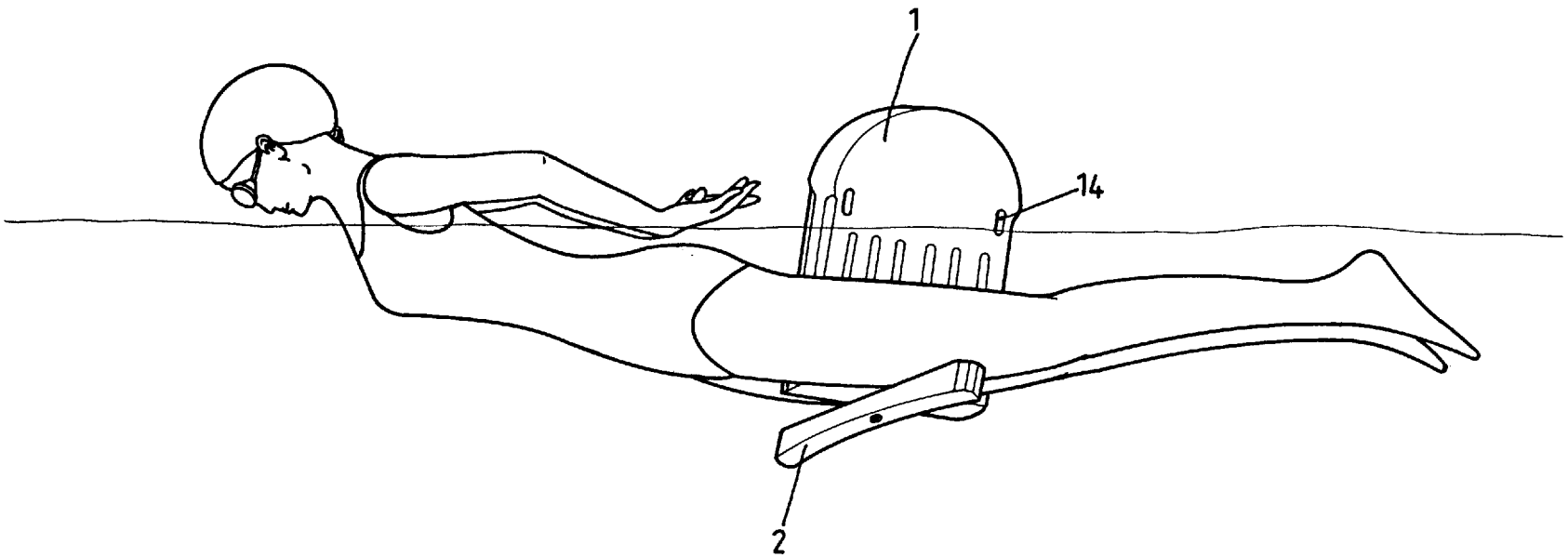
FIG. 3 is a schematic drawing showing a first application of the present invention.

Besides the above-mentioned usage of the conventional swimming float, there are new functions for the present invention, as follows. Referring to FIG. 3, the multipurpose float is used for training the hand swinging movement of the butterfly stroke. The bolt fastening the rotatable bar 2 is removed and the plug 22 of the rotatable bar 2 is then rotated 90°, so as to be perpendicular with respect to the main body 1. The quadrilateral plug 22 is inserted back into the quadrilateral recess 112, and fastened by screwing in the bolt back into the sleeve. The beginning swimmer grips the main body 1 between their thighs, with the rotatable bar 2 crossing beneath the thighs as a blocking bar to prevent the float from jumping out due to the buoyancy of the float.

Figure 4:
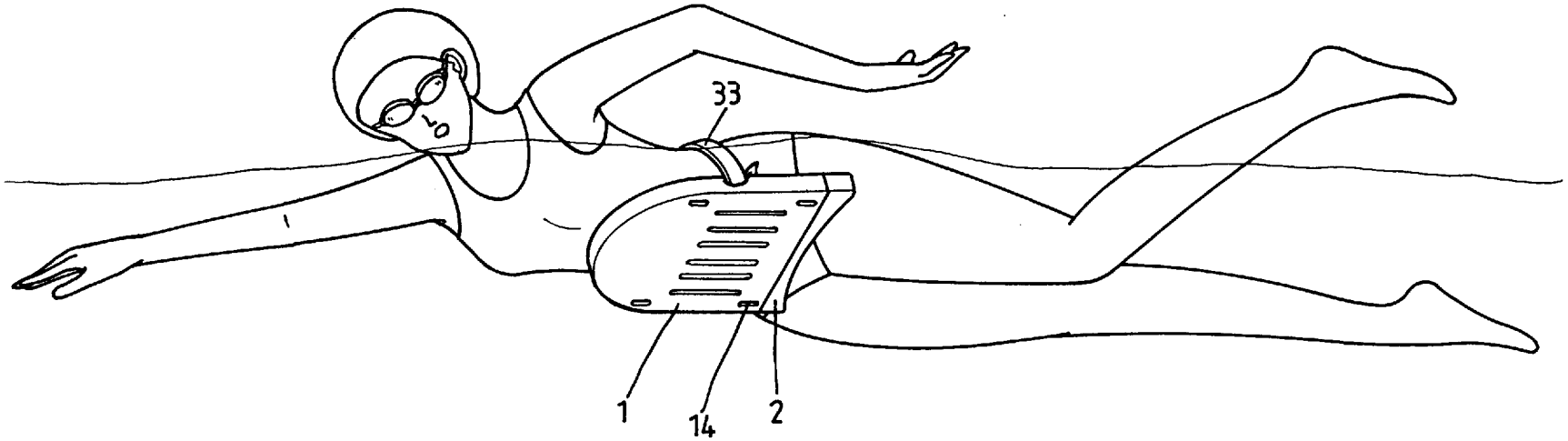
FIG. 4 is a schematic drawing showing a second application of the present invention.

In other cases, by means of the snap rings 32 of the bolts 3, a belt 33 can be used for fastening the float 10 on the belly of a beginning swimmer or drowning person, as shown in FIG. 4, to prevent the float from sliding off. In addition, as the float 10 is fastened on the body of the swimmer by a belt 33, another belt 33 can be secured to a coach for preventing the swimmer from swimming too far away, and makes the job of lifesaving easier.

Figure 5:
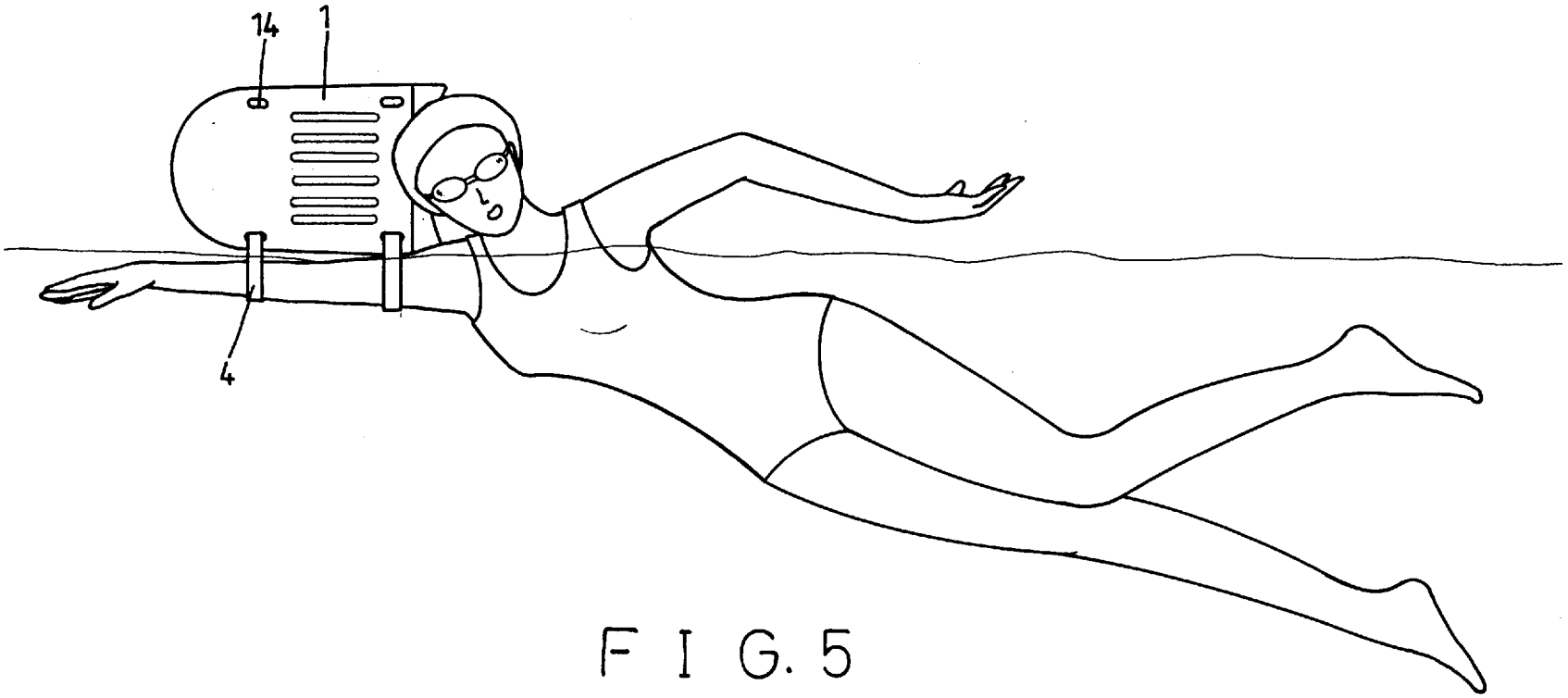
FIG. 5 is a schematic drawing showing a third application of the present invention.

Referring to FIG. 5, the float 10 is fastened on one arm with locking belts 4. The beginning swimmer can take advantage of the float 10 being fastened on one arm to train the movement of the free arm, such as paddling the water, especially as in finishing the swinging action of one arm and preparing to start the other arm's swinging action. The head of the beginner can tend to rest against the float so that the mouth can remain out of the water easily, for taking a breath. In this case, as the head of the swimmer tends to rest against the float 10, the buoyancy of the float 10 can counteract the effects of gravity, causing the body to tilt and aid the swimmer's head to remain out of the water so that breathing is calm and unhurried.

Figure 6:
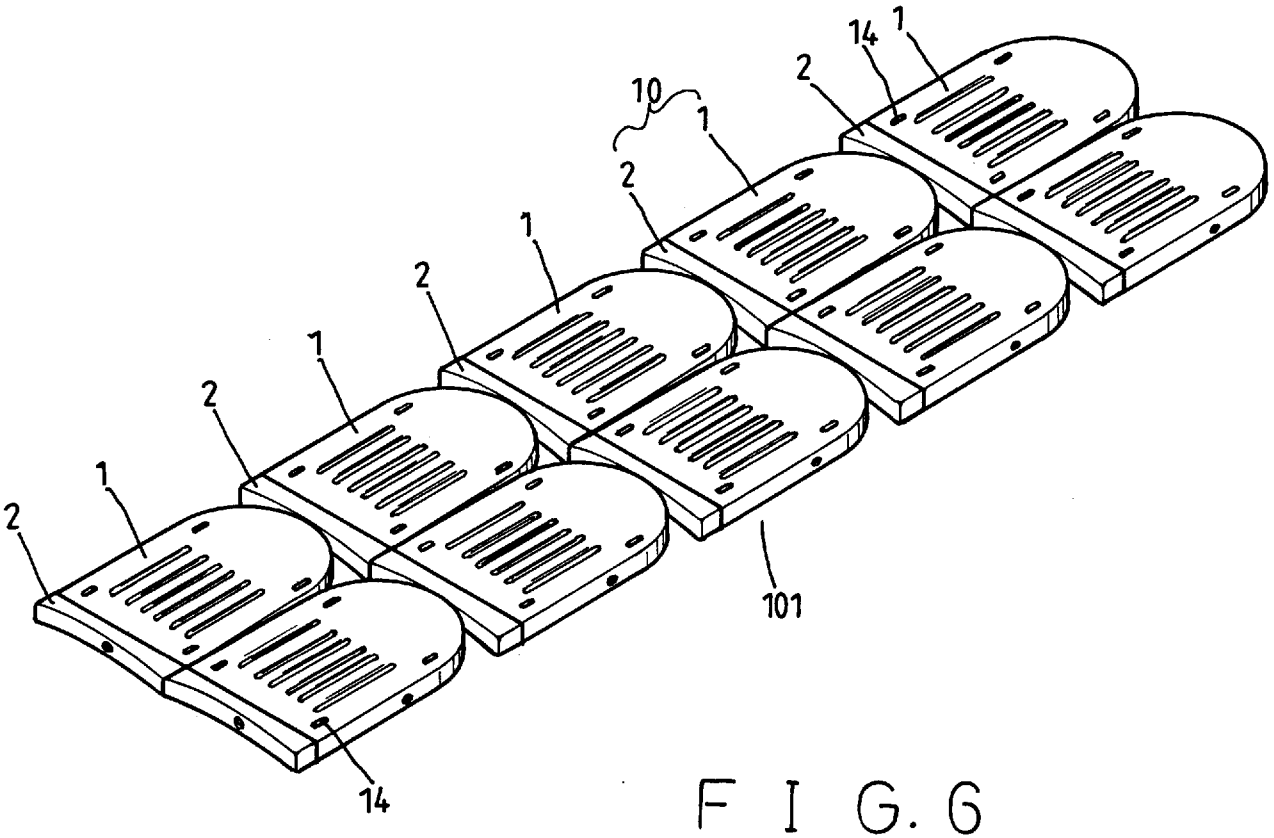
FIG. 6 is a schematic drawing showing a fourth application of the present invention; and, FIG. 7 is a partially sectioned, view of FIG. 6.
Figure 7:
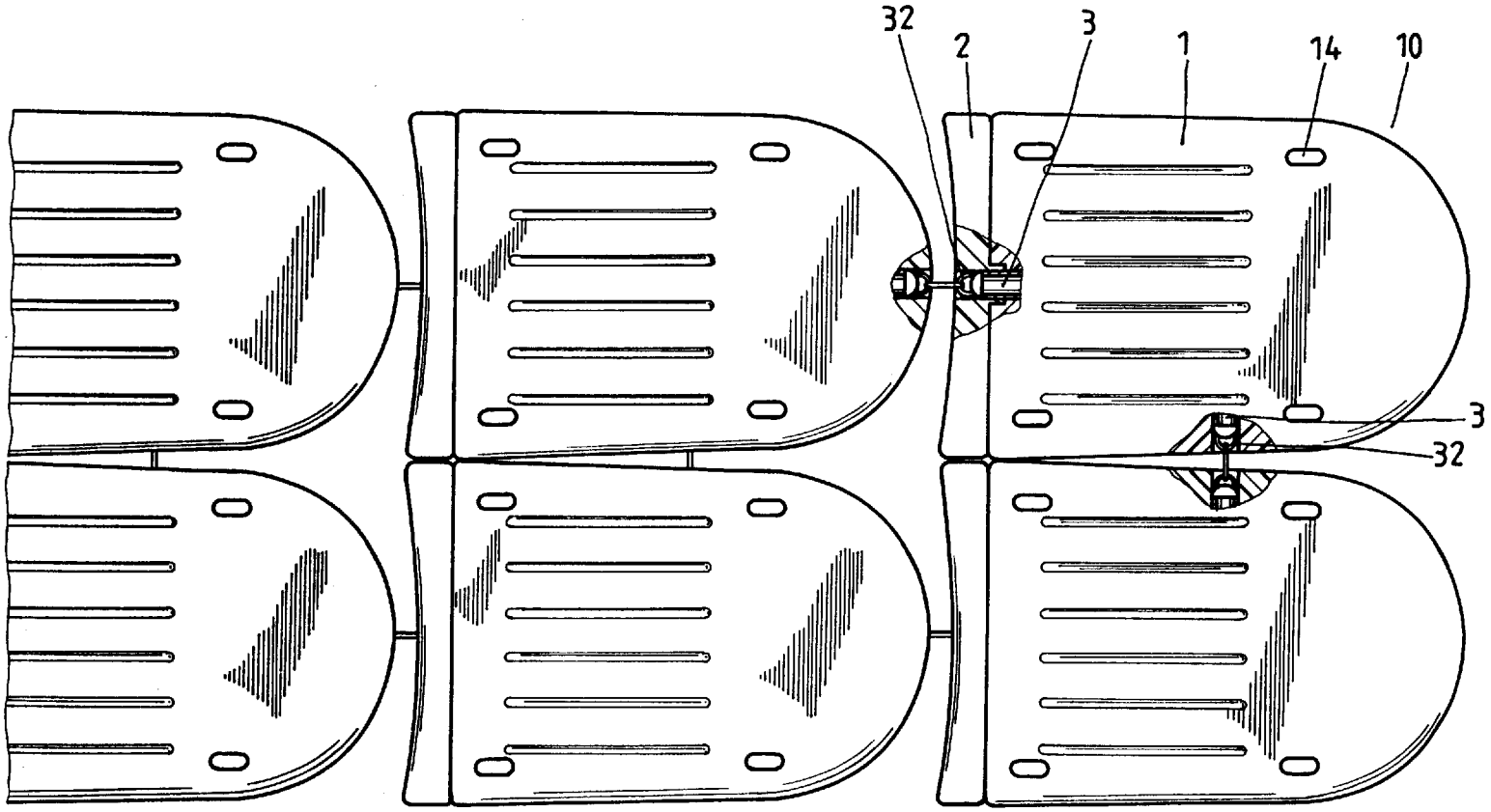

Additionally, the present invention can be used for playing and relaxing. Referring to FIGS. 6 and 7, the float 10 can be coupled to other floats by interconnecting the snap rings 32 to form a big float or a floating bed 101 for a swimmer to sunbathe, play and relax on. Moreover, the engaging length of the bolts 3 and sleeves 12 are sufficiently long so that they have enough resistance to external forces to keep the whole float 10 as an integral unit.

I claim:

1. A multipurpose float, comprising:

a main body having four side edges, each of said side edges having a centrally disposed deep hole formed therein, said main body having a plurality of slotted through openings formed adjacent a respective plurality of corner portions of said main body;

four hollow plastic sleeves respectively disposed within said deep holes, each of said plastic sleeves having a thread formed on an internal surface thereof;

four bolts respectively threadedly engaged with said four plastic sleeves, each of said bolts having a head formed on one end thereof and a snap ring coupled to said head;

a pair of locking belts respectively coupled to said main body through a selected pair of said plurality of slotted through openings; and, a rotatable bar having a centrally disposed opening formed therethrough, one of said four bolts being passed through said opening in said rotatable bar for coupling thereof to one of said side edges of said main body.

2. The multipurpose float as recited in claim 1 where said rotatable bar has a thickness dimension equivalent to a thickness dimension of said main body, said rotatable bar having a length dimension equivalent to a width dimension of said main body.

3. The multipurpose float as recited in claim 1 where each of said pair of locking belts include a plug joint and a socket joint for providing a releasable coupling of said locking belt with said main body and a user's body.

4. The multipurpose float as recited in claim 1 where said main body has a polygonal recess formed in an open end of one of said deep holes, said rotatable bar having a polygonal plug extending therefrom for insertion into said polygonal recess, said centrally disposed opening of said rotatable bar passing through said polygonal plug.

5. The multipurpose float as recited in claim 1 where each of said plastic sleeves is shorter than a depth of a respective deep hole in which said plastic sleeve is disposed to define a blind hole portion adjacent an open end of said deep hole for receiving a respective head and snap ring of said bolt therein.

* * * * *